United States Patent [19]

Greene et al.

[11] 3,944,217

[45] Mar. 16, 1976

[54] TOWER TYPE SORTING AND COLLATING APPARATUS

[75] Inventors: Ronald W. Greene, Seattle; Edmund I. Fagan, Bellevue; Jack D. Keeler, Seattle, all of Wash.

[73] Assignee: EMF Corporation, Seattle, Wash.

[22] Filed: Nov. 23, 1973

[21] Appl. No.: 418,570

[52] U.S. Cl. ..... 271/173; 271/198; 271/221; 271/223

[51] Int. Cl.[2] ..... B65H 29/58; B65H 31/24

[58] Field of Search ..... 271/173, 64, 200, 198, 271/221, 223; 270/58

[56] References Cited

UNITED STATES PATENTS

| | | | |
|---|---|---|---|
| 3,414,256 | 12/1968 | Mestre | 271/173 |
| 3,467,371 | 9/1969 | Britt et al. | 271/173 X |
| 3,484,101 | 12/1969 | Cassano | 271/173 |
| 3,545,744 | 12/1970 | Herman | 271/64 |
| 3,638,937 | 2/1972 | Schulz et al. | 271/173 |
| 3,649,006 | 3/1972 | Schenk | 271/173 |
| 3,658,324 | 4/1972 | Snellman | 271/64 X |

*Primary Examiner*—Evon C. Blunk
*Assistant Examiner*—Bruce H. Stoner, Jr.
*Attorney, Agent, or Firm*—Christensen, O'Connor, Garrison & Havelka

[57] ABSTRACT

Sorting and collating apparatus for use with copying and duplicating machinery for distribution of flexible sheet material to designated stations or series of stations. The device has an interface unit for accepting paper sheet copies and which selectively diverts said copies into a tray or to the base of the sorter tower. From the base the copies are either directed into the sorter tower to a designated bin or they are sent on to the next sorter tower module. The apparatus employs mass air movement type conveyors for paper transport. Means are provided for selectively diverting paper copies into designated paper receiving bins, and means may also be provided for maintaining the papers in aligned relationship in the individual paper receiving stations.

24 Claims, 13 Drawing Figures

34
76
58
68
76
40
74
72
30
82
86
80
34
122
120
30
42
44
38
32
12
54
40
76
58
5
5
68
68
58
60
62
56
122
120
82
84
88
90
36

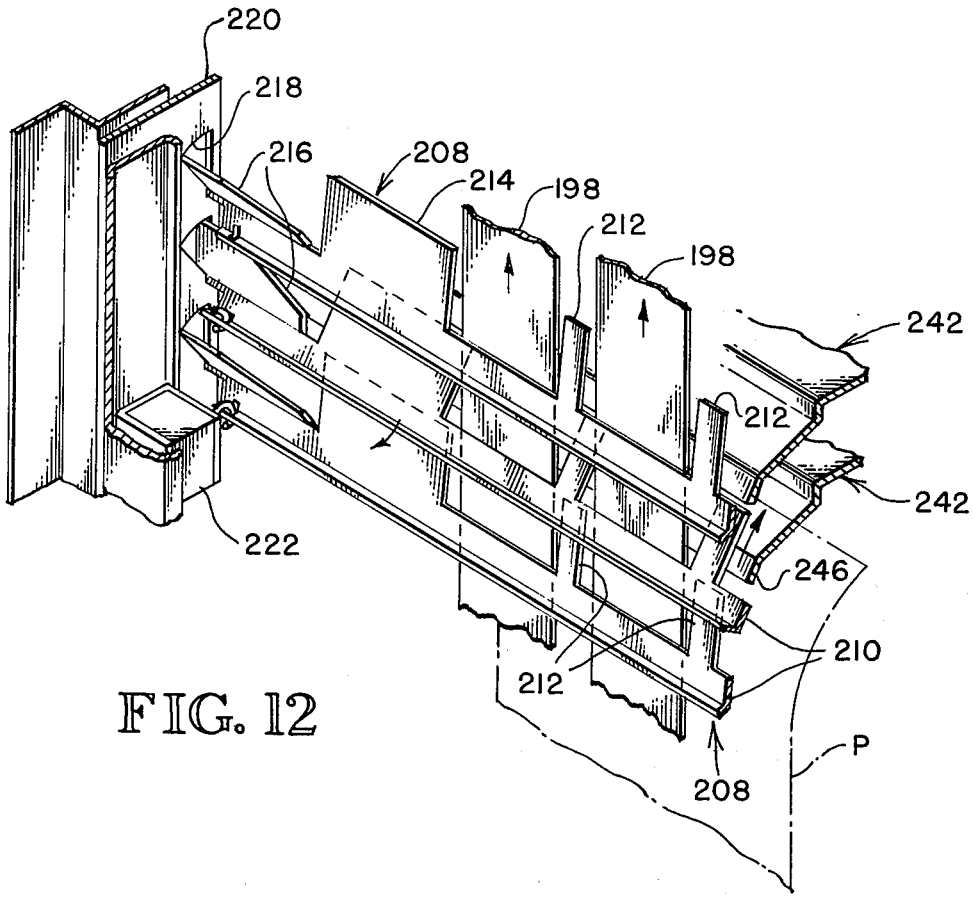
FIG. 12
FIG. 13
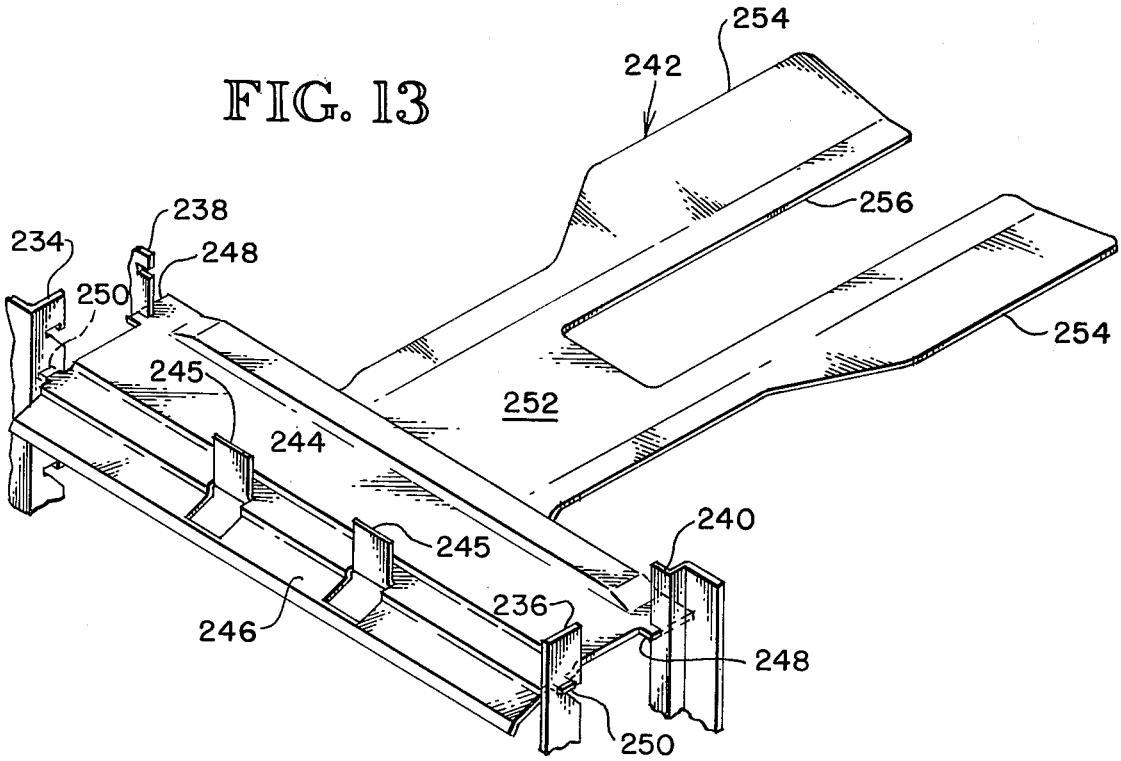

TOWER TYPE SORTING AND COLLATING APPARATUS

BACKGROUND OF INVENTION

This invention relates to sheet distributing devices and in particular to apparatuses adapted to separate and sort sheet material as it is fed into the apparatus from different types of reproducing, printing or copying machines.

Prior art sorters and/or collators have encountered many problems. One is that the rapid advances in copy producing machines have made increased demands on sorters and collators. For instance, the speed of a copy producing machine to reproduce a number of like sets of copy materials requires that the sorter have the capacity to accommodate changing work loads. The sorter or collator should be able to increase or decrease its capacity with modular slave units or units in tandem rather than requiring a variety of sizes in individual machines. Additionally, the types and weights of paper used in copy machines may differ substantially and the sorter or collator apparatus must be prepared to handle these differences. The variety of copy sorting jobs sorter-collators must handle suggests they should be modular to the extent that if one unit does not have the capacity the materials can be passed on to a second, third, etc., unit without any loss of time or extra handling of the copied material. While smaller collators or sorters are mainly intended for the office market as a necessary adjunct to office copying machines, the larger sorters and/or collators are more intended for the high production commercial market. That is, a machine with as many as 50 sorting bins in each tower can be used to stack books, brochures and/or catalogues for printers and other large volume, reproducing operations. With a number of modular units in tandem it is possible to print and sort catalogues, for instance, having hundred of pages. Those skilled in the art will appreciate the savings in labor that would otherwise be needed in handle the volume which modren day printing and/or duplicating machines can generate.

Among the prior art references which may be considered with respect to the features of this invention are the following: U.S. Pat. Nos. 3,372,922; 3,388,907; 3,572,685; 3,598,401; 3,646,372; 3,652,079; 3,460,824; 3,658,324; 3,467,371; 3,484,101; 3,395,913; 3,497,207; 3,618,936; and 3,649,006. The devices covered by the above list of patents are of interest only and not considered pertinent to the teachings of this invention.

SUMMARY OF INVENTION

As a paper copy emerges from the copier, duplicator or printing press device it is received on the angled conveyor of the interface unit. The copy can be then directed into a receiving tray mounted above the conveyor or directed onto the base section of the sorter tower. From the base the copy then may be directed on through to the next sorter tower or it can be deflected upwardly to the desired bin. The angle of the interface conveyor may be adjusted to conform to the height of the discharge level of the copy or duplicator machine. The interface unit includes, exclusive of the fan motors for the mass air transport, one motor for the conveyor and a larger motor for driving one or more tower modules in series or tandem. Each of the tower base units contains a through drive shaft with belt power take off for conveyor driver rollers. Each base unit drive shaft is connected to the preceding shaft by a coil wire coupling. The tower has a rigid upstanding portion in which the horizontal bins or trays are stacked. A conveyor is mounted in a separate section of the tower which pivots away from the entry side of the bins by hinges. Conveyor belts carry the sheets upwardly, which sheets are guided into the respective bins by individual bin deflector means which move out of the plane of the conveyor and deflect the leading edge of the paper into the entry end of a bins. The tower is additionally provided with an adjustable backstop and with a jogging and aligning mechanism.

Accordingly, it is among the many features, objects and advantages of this invention to provide a sorting and collating apparatus which is uniquely intended for use in commercial printing, reproducing, duplicating and copying shops, and it also is intended for other operations in which there are large volumes of paperwork which must be distributed to a number of persons or offices. The invention is particularly suited for use in printing shops for such things as multi-paged brochures, catalogues, and/or books which must be assembled in large numbers. The device handles a variety of types of paper including reliable transport and distribution of lightweight copy papers. The machine is capable of receiving sheets and distributing the same at high speeds demanded by present day advanced copying, printing and duplicating machines. The device by design lends itself to automatic programing for random or sequential sheet distribution. Paper jam-ups within the machine are made readily acceptable so that down time is negligible. The apparatus as noted above is designed to be modular depending on distribution capacty required.

BRIEF DESCRIPTION OF DRAWINGS

FIG. 12 is a partial view in perspective further illustrating details of the entry to the bins and the manner in which the deflectors direct sheets of paper into each bin; and FIG. 13 is a partial view in perspective further illustrating details of the mounting and configuration of the bins including the outer end center slot for accommodating the adjustable backstop.

DESCRIPTION OF THE PREFERRED EMBODIMENT

IN GENERAL

Figure 1:
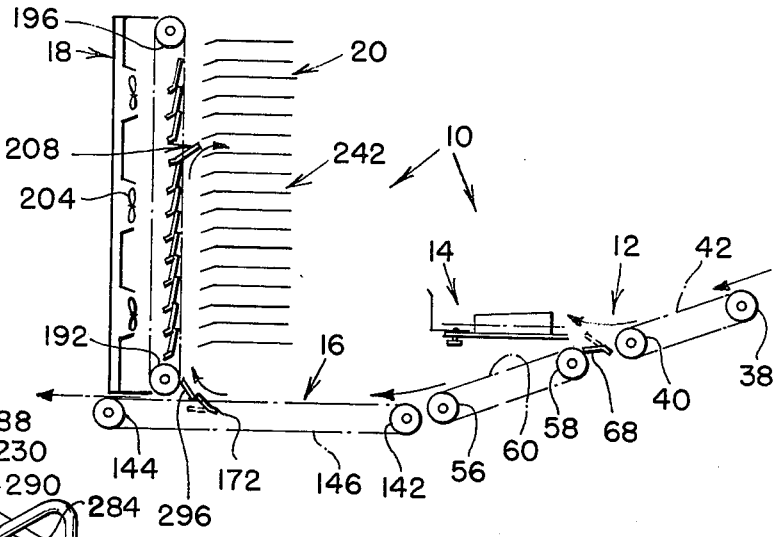
FIG. 1 is a side view diagrammatic showing generally the organization of the invention with arrows indicating the route a sheet of paper follows as it exits from the copying or duplicating apparatus.
Figure 2:
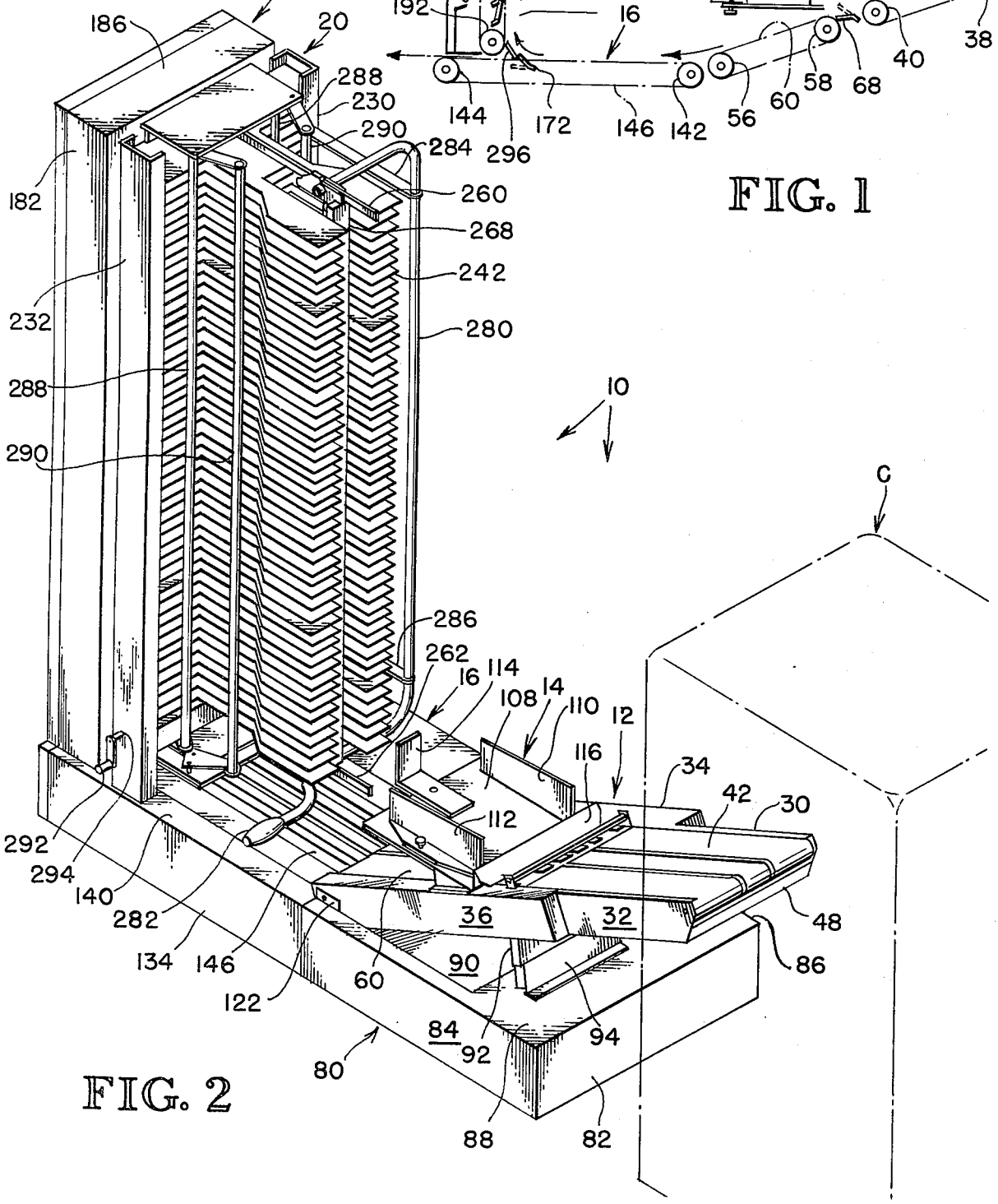
FIG. 2 is a perspective view showing in more detail the general organization of the parts and the manner in which the machine is set up with respect to the press, copier, or duplicator outlined in dash dot lines.

FIGS. 1 and 2 show the invention so as to make the following detailed views more meaningful. Shown in dash-dot lines is a copy or duplicating machine C such that its exit side for paper sheet copies is adjacent the interface portion of the sorter unit which sorter is generally designated by the number 10. The exit side of copy machine C will feed onto the interface unit generally designated by the number 12. Located atop the interface 12 is a proof or receiving tray generally designated by the number 14. From the interface unit 12 the paper sheets will go to the tower base generally designated by the number 16 where they are either transported on through to the next tower unit or directed upwardly on the vertical conveyor, designated by the number 18. The vertical conveyor section transports the paper sheets upwardly to the designated bin in the tower portion generally designated by the number 20.

INTERFACE SECTION

Referring now to FIGS. 2, 3, 4 and 5 it will be seen that the interface unit 12 is divided into two conveyor sections leading from the exit side of copy machine C. The interface unit 12 has upper outside frame members 30 and 32 and lower outside frame support members 34 and 36. At the upper end of interface unit 12 is idler roller 38 and near the center of the interface is driven roller 40. Extending around the rollers 38 and 40 is porous belt 42 which is shown to be in one piece extending from side to side of the interface unit with rubber-like strips 44 added to the belt to give additional surface friction for the paper sheets. The interface unit has a bottom wall 46 and an end wall 48 both of which extend across the bottom of the interface unit to substantially enclose together with side frame members 30 and 34 the space between the runs of belt 42 and the area beneath. An opening is provided in bottom wall for a fan shroud 50 in which is a fan 52 driven by fractional horse power motor 54. At the lower end or portion of interface unit 12 is another set of rollers, namely lower end idler 56 and drive roller 58 spaced a short distance from drive roller 40 of the other conveyor section. A continuous porous or web type belt 60 with rubber friction strips 62 extends around rollers 56 and 58. Again the lower section of interface 12 has a lower wall 64 extending between side members 34 and 36 to substantially enclose the area around the sides and beneath the lower conveyor section. An opening is provided around which is installed a fan shroud 66 together with its fans and drive motor (not shown). Located between drive rollers 40 and 58 and extending from side to side is a deflector 68 which is pivotally mounted for up and down movement. The paper sheets may be passed from belt 42 to belt 60 or if the deflector 68 is moved outwardly into the path of the paper said paper will be deflected into the proof tray assembly 14 to be described more fully hereinafter. The deflector 68 is actuated by solenoid 70. A motor 72, reference being had to FIG. 5, has pulley 74 around which is disposed belt 74 which also extends around driver rollers 40 and 58 for driving the respective conveyor sections.

Figure 3:
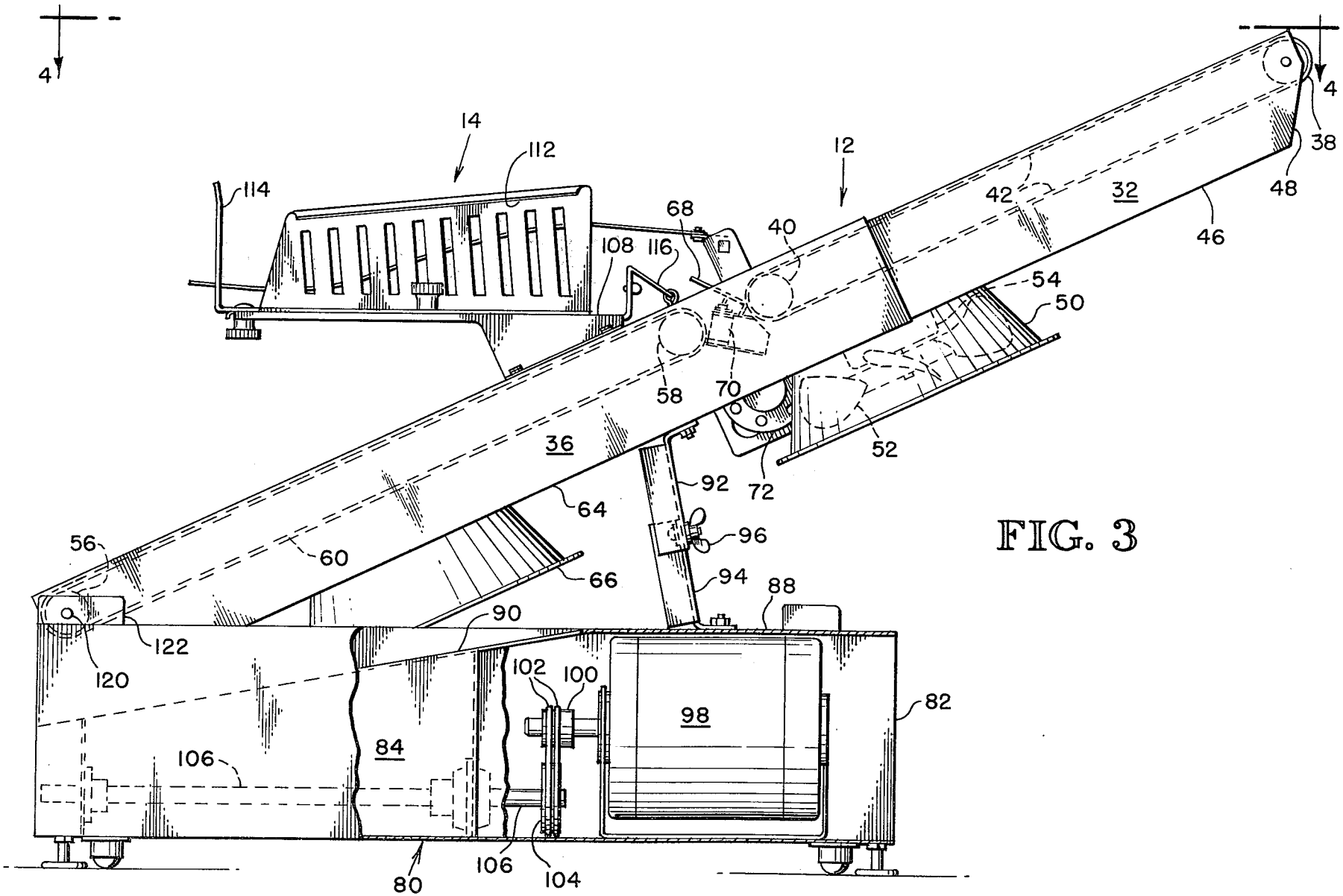
FIG. 3 is a side elevation view of the interface units.
Figures 4, 5:
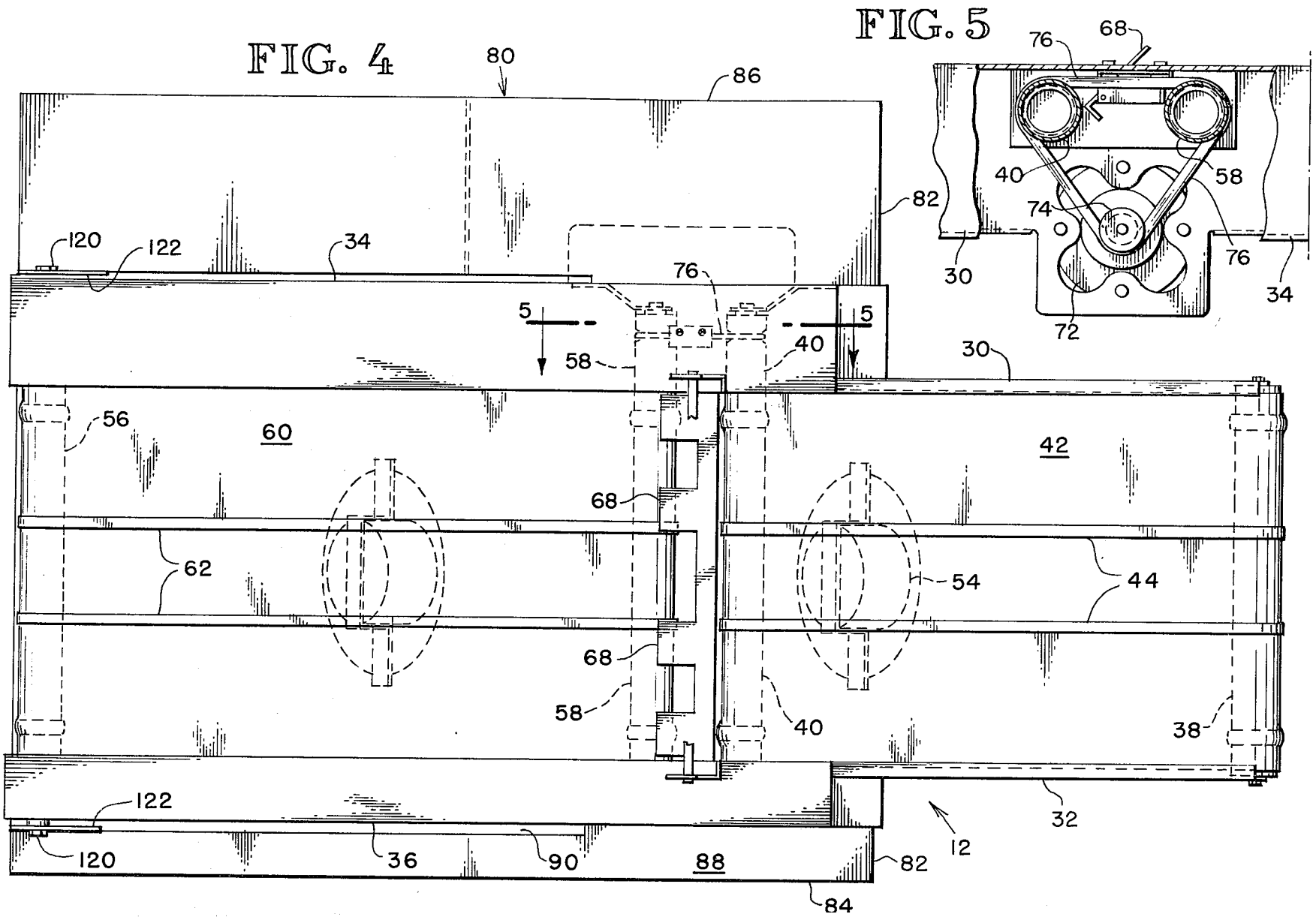
FIG. 4 is a top plan view taken from along the line 4—4 of FIG. 3 and further illustrating details of design and construction of the interface unit.
FIG. 5 is a partial cross-sectional elevational view of the roller drive taken along the line 5—5 of FIG. 4 and illustrating the manner in which the two conveyor sections of the interface unit are positively driven.

As can be seen by reference to FIGS. 3 and 4 the interface unit 12 is provided with a supporting base generally designated by the number 80. It has end wall 82, side walls 84 and 86, outer top wall section 88 and downwardly and rearwardly inclined top wall section 90. Extending between the bottom of the movable or pivotable conveyor section made up of conveyor portions 42 and 60 and top wall 88 of the base unit 80 are adjustment arms 92 and 94 allowing the height of the outer end of the conveyor section to be raised or lowered. A wing nut 96 or other securing means may be employed to secure the height adjustment arms 92 and 94 together. Within base unit 80 is main sorter drive motor 98 having drive pulley 100 and drive belt or belts 102. Belts 102 in turn extend around shaft pulley 104 for driving main drive shaft 106. As can be seen particularly in FIG. 3 main drive shaft 106 extends toward the tower base unit and terminates approximately at the inner end of interface base unit 80 where means are provided for spring coupling it to an aligned shaft within the tower base, details of which are to be described more fully hereinafter. Obviously, shaft 106 will be supported by appropriate bearing structure within base unit 80. The lower end of the conveyor section of the interface is pivotally attached as at 120 to brackets 122 attached to base portion 80.

Referring again to the proof tray 14 it will be seen that it has proof tray floor 108, width adjustable side walls 110 and 112, and rear stop wall 114. An angled paper guide surface 112 is interposed at the front or entrance end of tray 14 to aid delfector 68 in getting paper sheets into said tray.

SORTER BASE

Figure 6:
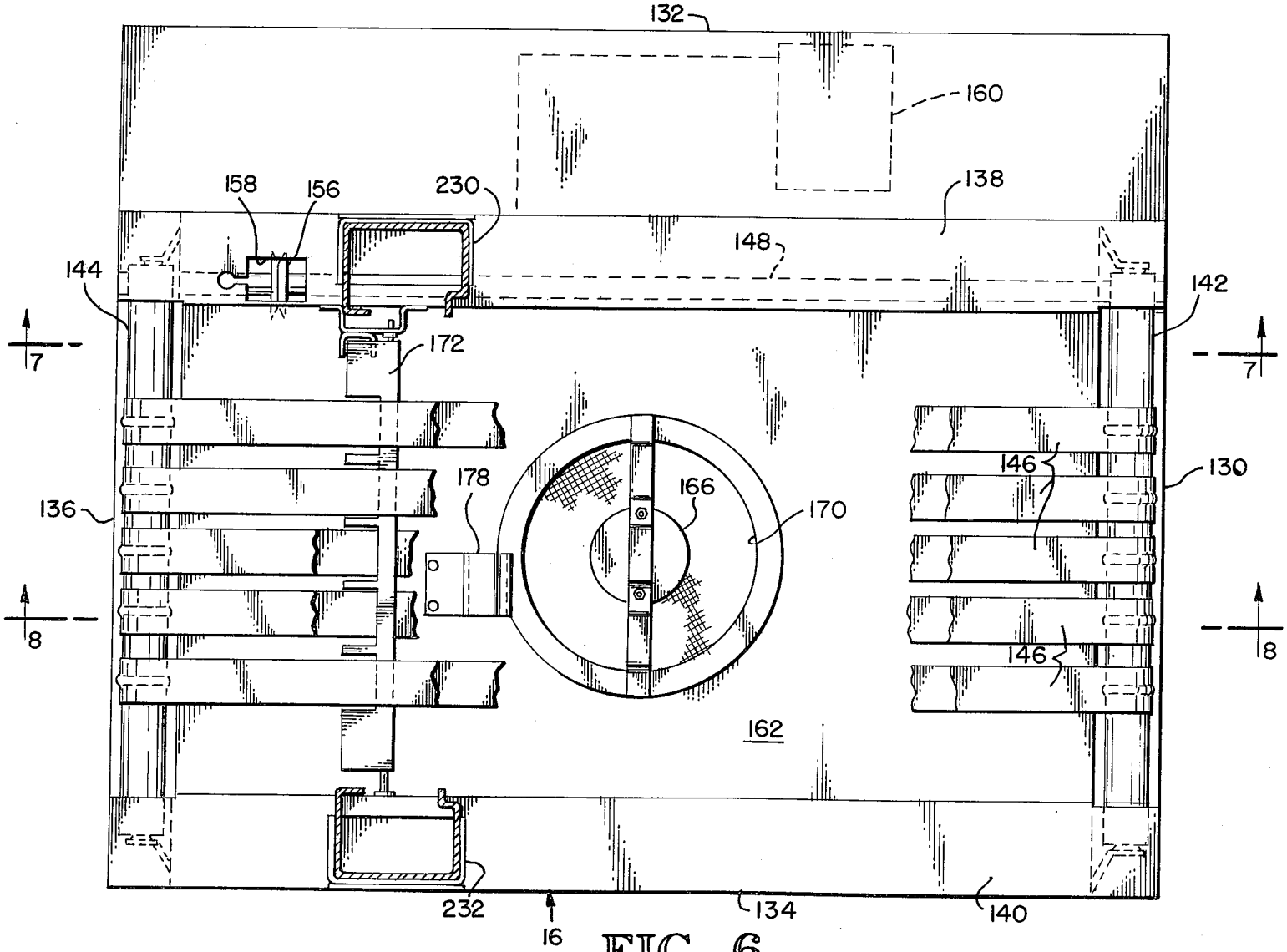
FIG. 6 is a top plan view of the base section of the tower.
Figure 7:
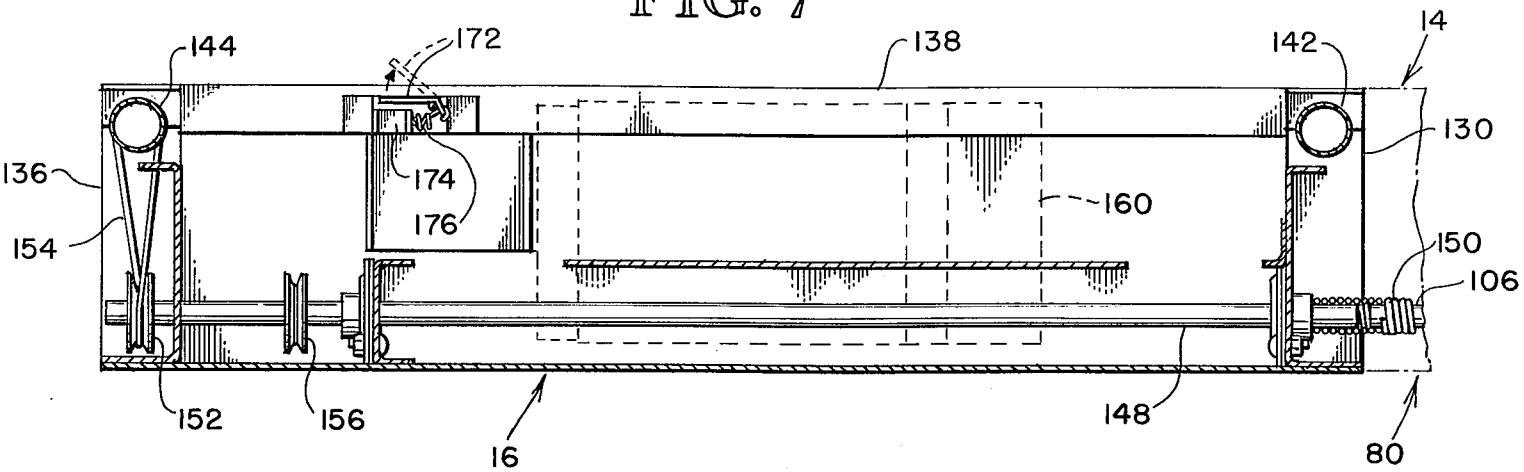
FIG. 7 is a cross-sectional view taken in vertical along the line 7—7 of FIG. 6 and showing details of the base section.
Figure 8:
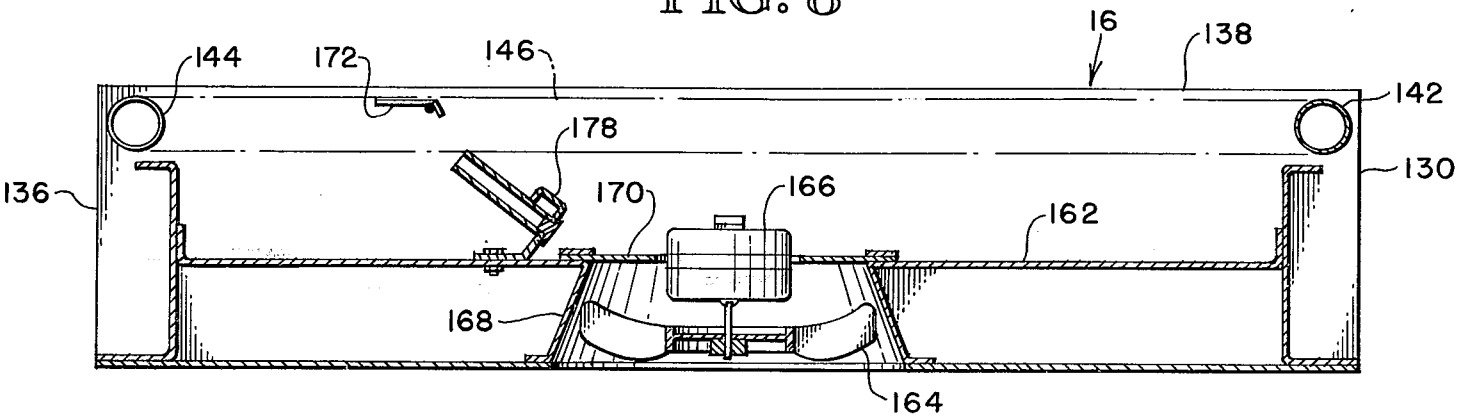
FIG. 8 is a vertical cross-sectional view taken along the line 8—8 of FIG. 6 further illustrating details of construction and design of the base section.

The tower base, generally designated by the number 16 has front wall 130, side walls 132 and 134 and rear wall 136. The tower base 16 also has top side edge surfaces 138 and 140. At the front end is disposed idler roller 142 and at the back end is located drive roller 144. Extending around rollers 142 and 144 are a series of narrow spaced apart porous continuous belt members 146. Shaft 106 of the interface base section 80 is seen in FIG. 7. The tower base 16 butts against the interface unit as shown in FIG. 1 in such a way that drive shaft 106 of the interface is aligned with the drive shaft section 148 in the tower base. The shafts are connected by a spring coupling 150 and shaft 148 extends to rear end 136 as shown in FIG. 7. A pulley 152 located on drive shaft 148 generally directly below the drive roller 144 positively drives said roller belt 154. A second pulley 156 is secured to shaft 148 in the position shown in both of FIGS. 6 and 7 for purposes which will be explained more fully under discussion of the tower portions of the invention. An opening 158 is provided in top edge wall 138 for permitting a drive belt to reach or extend to a drive pulley or roller in the tower. Control and electronic equipment 160 are included in the space between side edge 132 and the area generally accommodating shaft 148. Located below the lower run of the belts 146 is an intermediate wall 162 extending generally from end to end of the base section 16 and from side to side thereof. Located generally in the center of base section 16 is fan 164 with its fractional horsepower drive motor 166 and fan shroud 168 extending downwardly from opening 170.

Referring again to FIG. 6 it will be seen that a deflector 172 extends across the base unit with appropriate fingers between belts for deflecting the sheets up into the tower when deflector is in the position shown in dotted lines in FIG. 7. A solenoid 174 actuates the deflector 172 into its up position against the compression of spring 176 which normally biases deflector 172 into its down position shown in dotted lines in FIG. 7. A photo cell mounting bracket 178 is provided on intermediate horizontal wall 162, which photo cell (not shown) is used in the control system of the invention. Thus, it will be seen that a continuous conveyor is provided for the sheets coming off the interface section and which sheets may be directed upwardly into the tower to be described more fully hereinafter or if several towers are placed in tandem the sheets may be directed on through by lowering deflector 172.

SORTER TOWER

The tower portion of the sorter is comprised essentially of two sections. One is the conveyor section generally designated by the number 18 and the other is the tray section generally designated by the number 20. In this discussion the vertical conveyor section 18 will be described first principally be reference to FIGS. 9, 10 and 11. The conveyor section 18 is defined, reference being had also to FIG. 1, by side walls 180 and 182, back wall 184 and top wall 186. It will be seen that the inside or conveyor face has vertical side edge walls 188 and 190 which extend inwardly generally in the plane of the conveyor belts described hereinafter. At the lower end of the tower and just above the base portion 60 is located drive roller 192 connected to base portion drive shaft pulley 156 by belt 194. At the upper end of tower section 18 is idler roller 196 around which extends a plurality of belts 198 which are porous and generally equi-spaced from each other. Belts 198 are preferrably porous so that air will move through the conveyor section 18 from top to bottom through the entire length of the vertical belt run. Behind the belts 198 is a vertical intermediate wall 200 in which are located fan shrouds 202 of which there may be a plurality depending on the amount of air which must be moved through the vertical conveyor. In each fan shroud is a fan 204 with motor 206. A back wall is spaced rearwardly of the fans and encloses the back of the conveyor section 18 and which will obviously have openings so that air moved by fans 204 can be exhausted from the device and away from the trays of the next sorter tower.

Figure 11:
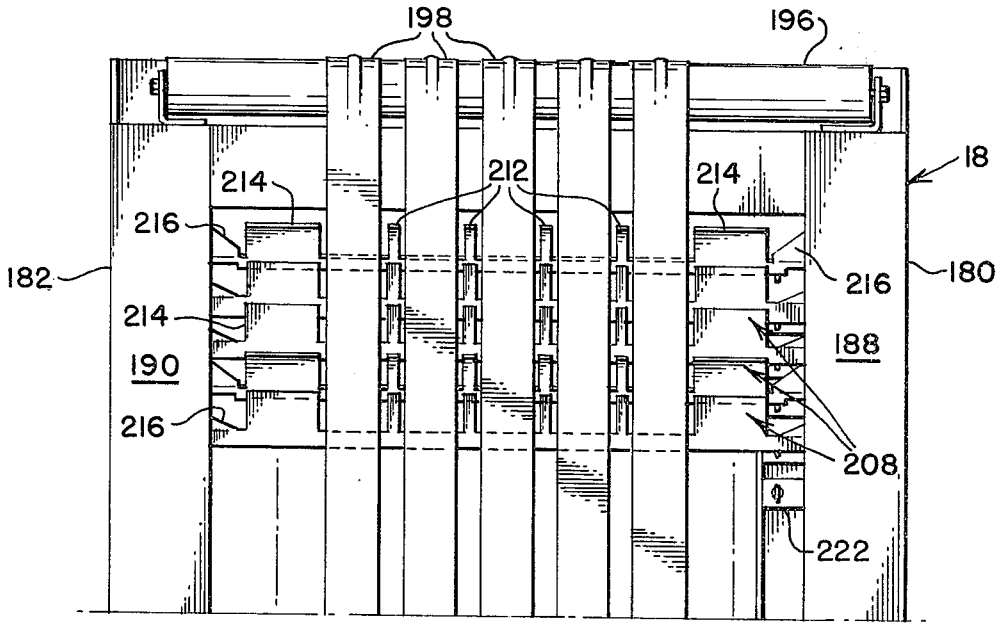
FIG. 11 is a vertical cross-sectional view taken along the line 11—11 of FIG. 9 and further illustrating details of the vertical transport portion of the tower.

On the conveyor face of the conveyor section 18 are a series of deflectors generally designated by the number 208, details of which are best seen in FIGS. 11 and 12. Note that the deflectors have an L-shaped base piece 210 extending from side to side of the conveyor face between vertical edge wall section 188 and 190. A series of narrow fingers 212 and wider fingers 214 are located between the belts and the edge walls 188 and 190. Also at the outer ends of each deflector 208 are guide pieces 216 which act as movement limiters within the arcuate openings 218 is side frame member 220 as best seen in FIG. 12. Each of the deflectors 208 is provided with a solenoid 222 which is normally biased so that the deflectors 208 are retracted with the guide piece 216 being at the back edge of arcuate openings 218. When a solenoid 222 is actuated the deflector 208 is moved outwardly to intercept paper moving up the conveyor belts by extending fingers 212 and 214 into the path of the paper as may best be seen in FIGS. 9 and 12.

Figure 9:
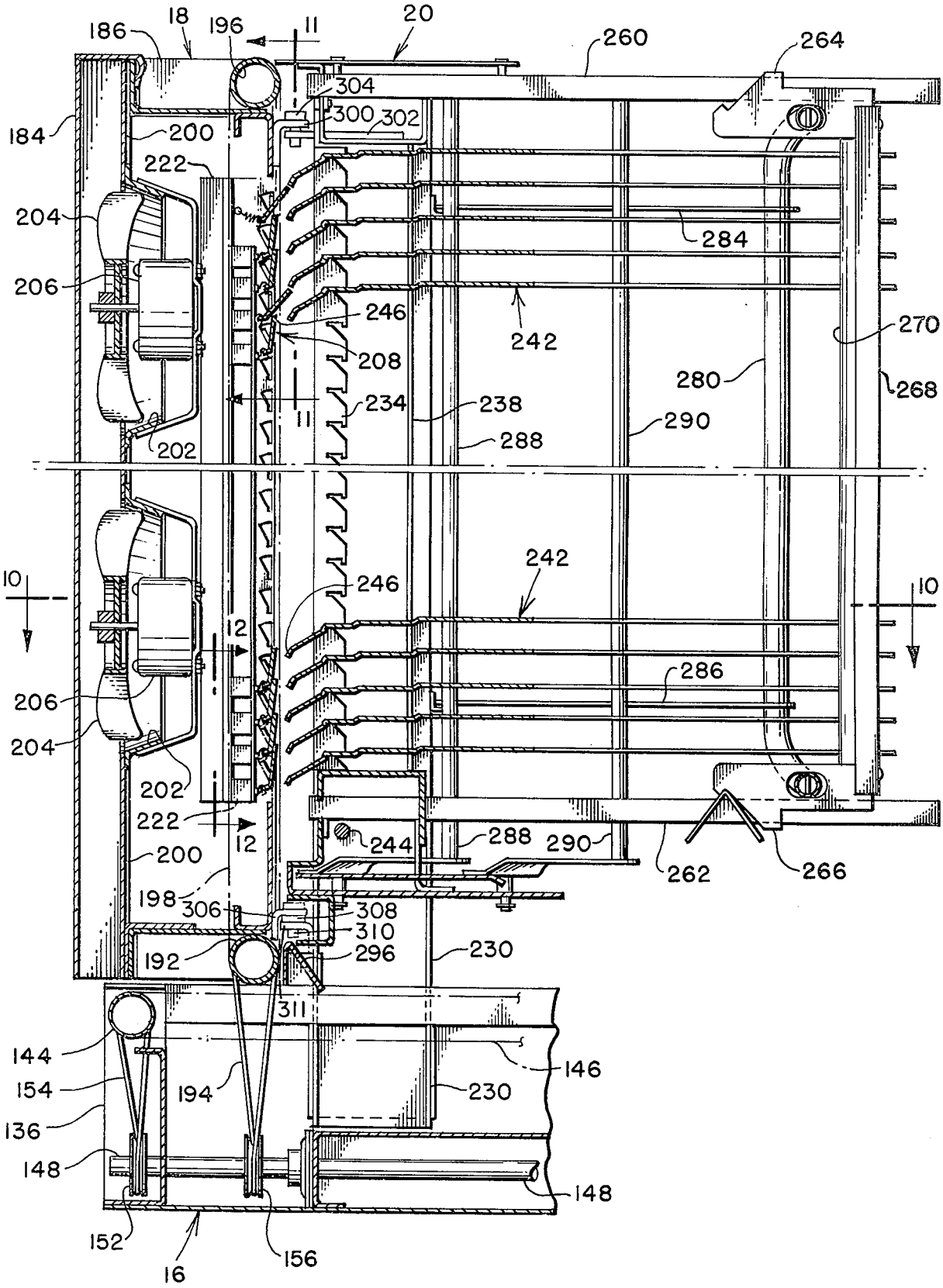
FIG. 9 is a partial cross-sectional view with repetitous details cut away to show more particularly features of the bins, vertical transport, deflectors and pivotal transport section as it is mounted on the base section.
Figure 10:
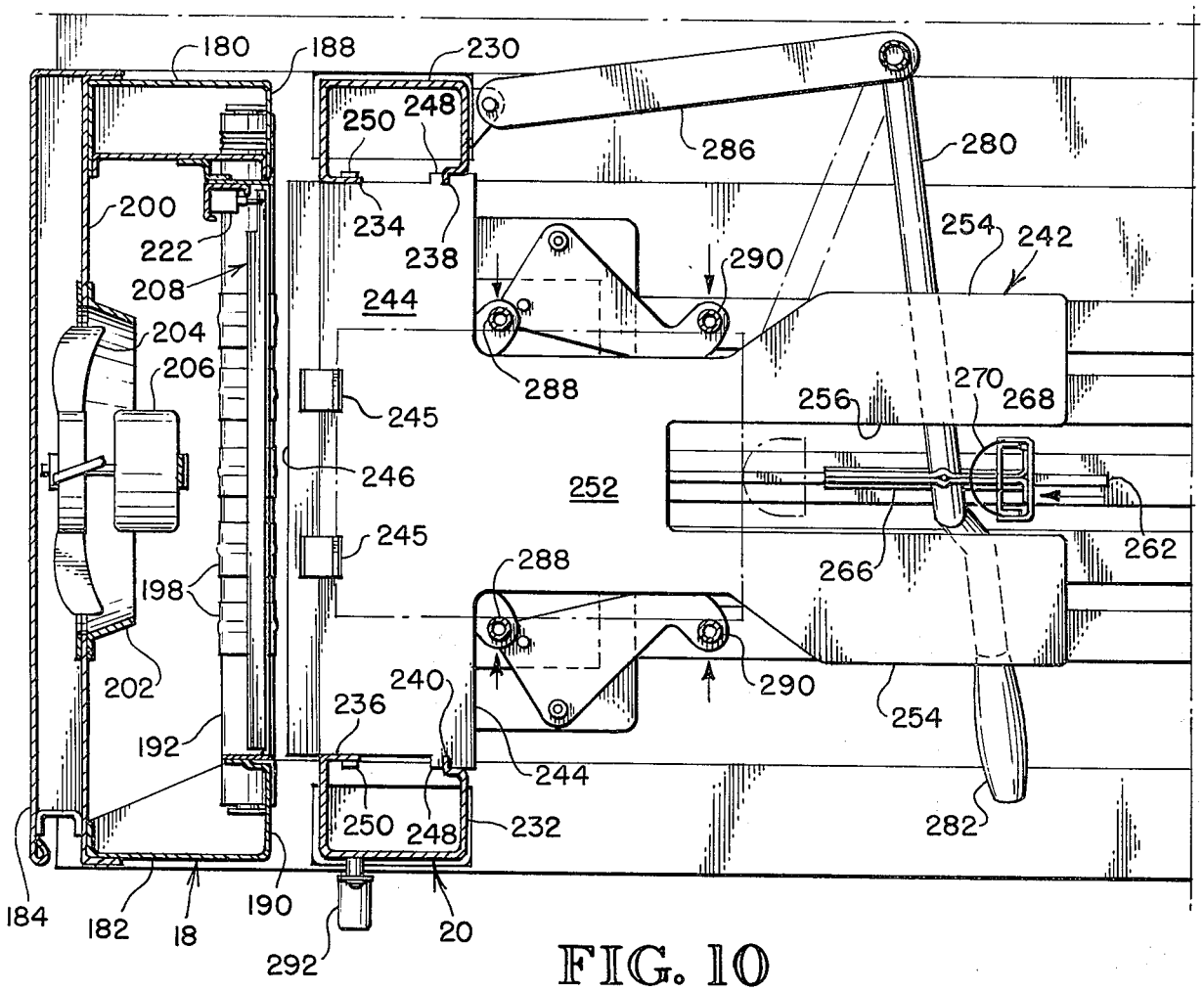
FIG. 10 is a top plan view taken along the line 10—10 of FIG. 9 further illustrating detail of the tower structure.

The tray portion 20 of the tower has two upstanding side frame members 230 and 232 which are supported securely by the tower base unit 16. The conveyor section 18 of the tower is hingedly attached to the tower section 20 so that the side identified as 182 of the conveyor section 18 will swing away a limited distance in order to allow an operator to reach in and remove paper jams, make adjustments or for whatever reason it may be necessary to gain access to the area between the two sections 18 and 20 of the tower. As can be seen the two main tower support frame pieces 230 and 232 most nearly resemble a box type beam, and are best seen in FIG. 10. Thus, the two side frame members have back or rear flange 234 and 235 respectively which are generally parallel to the outside of the frame. The frame piece members 230 and 232 also have short front flanges 238 and 240 respectively which are generally at a 90° angle to the outside. Thus, by reference to FIG. 13 in which only the tray support flanges are shown, it is seen more clearly how the trays, generally identified by the number 242, are supported in the tower. It will be seen by reference to FIG. 9 that the conveyor section 18 is hinged at its upper end to tray section 20 by L-shaped hinge bracket 300 secured to the conveyor section and hinge bracket 302 secured to the tray section. A removable hinge pin 304 is received in aligned holes in brackets 300 and 302. At the lower end of the conveyor section a bracket 306 is secured to the conveyor section and has a hole for receiving pin 310. The pin 310 extends into an aligned hole in the bracket 311 secured to the tray section. A spacing washer 308 between the brackets 310 and 311 maintains the conveyor section in spaced relation to the base.

The trays have a receiver portion 244 extending between the main support frame members with a receiver lip 246 being slightly to the rear of the frame members also extending the length of the receiver 244. The lips 246 are that part of the trays 242 which is closest to the conveyor belts 198. It will be noted that the support section 244 of the trays has front support projections 248 and rear support projection 250 which are received in appropriate slots in the tray support flanges. Thus, the trays 242 are readily removable and replaceable. Extending outwardly from the main support section 244 of the trays is the tray section which may be dished as shown in FIG. 13. A narrow neck portion 252 is formed into the tray so that the aligning and jogging mechanism may move into contact against the side edges of the paper as they are sorted into the trays. The tray itself widens to the outer end sections 254. An opening is cut into the tray from the outer end and extending into the neck area 252 to accommodate a vertically extending backstop shown in FIGS. 1, 9 and 10. A pair of top and bottom backstop support bars 260 and 262 respectively have slidably received thereon a slide support assembly 264 on the top bar 260 and a slide support assembly 266 on the bottom bar 262. The backstop member comprises a channel shaped frame piece 268 extending between the slide support assemblies 264 and 266. A resilient backstop material such as foam rubber or an arcuate plastic or rubber material 270 faces inwardly and absorbs the energy of the paper sheets as they are directed into each tray. A U-shaped interconnect or torque tube 280 extends outwardly to one side from top to bottom to synchronize movement at top and bottom as shown in FIGS. 2 and 9. At the lower end is a handle 282 attached to slide assembly 266 so that as shown in FIG. 10 the backstop may be easily moved forward or rearwardly depending on the size paper which is being sorted at a given moment. Upper and lower support bars 284 and 286 respectively provide the fulcrum by which the interconnecting torque rod 280 is further supported from main side frame member 230.

Inner and outer paper jogging and aligning rods 288 and 290 respectively on each side of the neck portion 252 of the trays are periodically actuated to align the stacks of paper being admitted to the trays. Again the jogger and aligning rods 288 and 290 can be adjusted in and out by virtue of a crank 292 attached to shaft 294 which is attached to mechanism not shown. It is sufficient to say that after each series of papers has come into the trays the bars 288 and 290 will move inwardly to align the new paper sheets with the remainder of the stack. A guide surface 296 at the bottom of the tower near lower conveyor drive roller 192 functions, as schematically shown in FIG. 1, with tower base deflector 172 to guide the oncoming sheets onto the vertical conveyor.

What is claimed is:

1. Tower type sheet sorting apparatus, comprising:

a. an interface section for accepting sheets from a reproducing machine, said interface section including an interface base portion, an interface conveyor portion on said interface base portion, such that said interface conveyor portion angles generally downwardly from said reproducing machine, proof tray means located over said interface conveyor portion and first deflector means for selectively directing sheets off said interface conveyor portion into said proof tray, b. a sorter base connected to said interface base portion having a generally horizontally disposed sorter base conveyor means for receiving sheets from the lower end of said interface conveyor portion, said sorter base including a second deflector means for directing sheets upwardly into a sorter tower assembly supported on said sorter base or to allow said sheets to continue on said sorter base conveyor means, c. a sorter tower assembly on said sorter base and including a tower bin section rigidly supported on said sorter base, said bin section having a vertical array of generally horizontally disposed, spaced apart paper copy receiving trays, and d. a generally vertically disposed tower conveyor section pivotally supported on said tower bin section for receiving sheets from said sorter base conveyor means when directed upwardly by said second deflector means, and also including a plurality of third deflector means for directing sheets into said trays.

2. The sheet sorting apparatus according to claim 1 and in which said interface section includes power means for driving the sorter base conveyor means and the tower conveyor section of one or more sorter base and sorter tower sheet sorting apparatuses.

3. The sheet sorting apparatus according to claim 2 and in which interface section includes two interface conveyors between which said first deflector means for said proof tray is located.

4. The sheet sorting apparatus according to claim 2 and in which said power means in said interface section turns a drive shaft for transmitting power to one or more sorter base and sorter tower apparatuses.

5. The tower type sheet sorting apparatus according to claim 4 and in which said sorter base is provided with a drive shaft in alignment with the drive shaft of said interface section and wherein detachable coupling means are incorporated to drivingly connect the two drive shafts.

6. The sheet sorting apparatus according to claim 5 and wherein power from the drive shaft in said sorter base section is used to drive both the sorter base conveyor means and the sorter tower conveyor section.

7. The sheet sorting apparatus according to claim 6 and wherein said third deflector means for said trays are generally within or in close proximity to the plane of the tower conveyor when retracted.

8. The sheet sorting apparatus according to claim 2 and wherein said sorter tower conveyor section consists of a plurality of spaced apart belts between at least some of which are located said third deflector means.

9. The sheets sorting apparatus according to claim 8 and in which an adjustable vertical backstop means is provided against which the leading edges of the sheets are engaged for assisting in evening the front and rear end edges of papers within said trays.

10. The sheet sorting apparatus according to claim 1 and in which the angle of disposition of said interface conveyor portion is adjustable with respect to its base according to the height of the duplicating machine with which it is used.

11. The sheet sorting apparatus according to claim 1 and in which the third deflector means in said sorter tower for said trays includes a separate third deflector and actuating mechanism for each of said trays.

12. The sheet sorting apparatus of claim 1 and in which paper jogging the aligning devices are located on each side of the trays for tapping and evening the side edges of the stacks of papers in said trays.

13. Tower type sheet sorting apparatus comprising:

a. an interface section for accepting sheets from a reproducing machine, said interface section including interface base and interface conveyor portions and also including proof tray means located above the conveyor and first deflector means for directing sheets into said proof tray or for permitting the sheets to continue on to the sorter section of said apparatus, b. a sorter base connected to said interface section including a sorter base conveyor and a second deflector means for directing sheets upwardly into a tower section supported on said sorter base or on through to exit the same from the apparatus, c. a sorter tower assembly on said sorter base and including a tower tray section supported on said sorter base and having a vertical array of generally horizontally disposed, spaced apart paper copy receiving trays, and d. a tower conveyor section for transporting sheets upwardly from said sorter base conveyor and which is pivotally connected to said tower tray section so that if a jam occurs the tower conveyor section can be swung away from said tray section to allow rapid and easy access for removal of said jam, said tower conveyor section further including third deflector means for directing sheets into said trays.

14. The sheet sorting apparatus according to claim 13 and in which said interface section includes power means for driving the sorter base conveyor and the tower conveyor section of one or more sorter base and sorter tower sheet sorting apparatuses.

15. The sheet sorting apparatus according to claim 14 and in which said power means in said interface section turns a drive shaft for transmitting power to one or more sorter base and sorter tower apparatuses.

16. The tower type sheet sorting apparatus according to claim 15 and in which said sorter base is provided with a drive shaft in alignment with the drive shaft of said interface section and wherein detachable coupling means are incorporated to drivingly connect the two drive shafts.

17. The sheet sorting apparatus according to claim 16 and wherein power from the drive shaft in said sorter base section is used to drive both the sorter base conveyor and the sorter tower conveyor section.

18. The sheet sorting apparatus according to claim 17 and wherein said sorter tower conveyor consists of a plurality of spaced apart belts between at least some of which are located said third deflector means.

19. The sheet sorting apparatus according to claim 13 and in which said interface section includes two interface conveyor portions between which said first deflector means for said proof tray is located.

20. The sheet sorting apparatus according to claim 13 and in which the angle of disposition of said interface conveyor section is adjustable with respect to its base according to the height of the duplicating machine with which it is used.

21. The sheet sorting apparatus according to claim 13 and in which the third deflector means in said sorter tower for said trays include a separate third deflector and actuating mechanism for each of said trays.

22. The sheet sorting apparatus according to claim 13 and wherein said third deflector means for said trays are generally within or in close proximity to the plane of the tower conveyor when retracted.

23. The sheet sorting apparatus of claim 13 and in which paper jogging and aligning devices are located on each side of the trays for tapping and evening the side edges of the stacks in said trays.

24. The sheet sorting apparatus according to claim 23 and in which an adjustable vertical backstop means is provided against which the leading edges of the sheets are engaged for assisting in evening the front and rear end edges of papers within the trays.

* * * * *